US010000828B2

(12) United States Patent
Parson et al.

(10) Patent No.: US 10,000,828 B2
(45) Date of Patent: Jun. 19, 2018

(54) ALUMINUM ALLOY HAVING AN EXCELLENT COMBINATION OF STRENGTH, EXTRUDABILITY AND CORROSION RESISTANCE

(71) Applicant: RIO TINTO ALCAN INTERNATIONAL LIMITED, Montréal (CA)

(72) Inventors: Nicholas Charles Parson, Kingston (CA); Raynald Guay, Jonquiére (CA); Alexandre Maltais, Chicoutimi (CA)

(73) Assignee: Rio Tinto Alcan International Limited, Montreal (CA)

( * ) Notice: Subject to any disclaimer, the term of this patent is extended or adjusted under 35 U.S.C. 154(b) by 152 days.

(21) Appl. No.: 14/397,263

(22) PCT Filed: Apr. 26, 2013

(86) PCT No.: PCT/CA2013/050320

§ 371 (c)(1),
(2) Date: Oct. 27, 2014

(87) PCT Pub. No.: WO2013/159233

PCT Pub. Date: Oct. 31, 2013

(65) Prior Publication Data

US 2016/0153073 A1 Jun. 2, 2016

Related U.S. Application Data

(60) Provisional application No. 61/639,444, filed on Apr. 27, 2014, provisional application No. 61/643,637, filed on May 7, 2012.

(30) Foreign Application Priority Data

Apr. 27, 2012 (CA) ..... 2776003

(51) Int. Cl.
*C22C 21/00* (2006.01)
*C22F 1/04* (2006.01)
(Continued)

(52) U.S. Cl.
CPC ..... *C22C 21/00* (2013.01); *B21C 23/002* (2013.01); *C21D 1/28* (2013.01); *C21D 9/08* (2013.01);
(Continued)

(58) Field of Classification Search
CPC ..... C22C 21/00; C22F 1/04
See application file for complete search history.

(56) References Cited

U.S. PATENT DOCUMENTS 5,286,316 A 2/1994 Wade
6,284,386 B1 9/2001 Jeffrey et al.
(Continued)

FOREIGN PATENT DOCUMENTS

CA 2493401 A1 3/2004
CA 2510759 A1 7/2004
(Continued)

OTHER PUBLICATIONS

International Search Report dated Jul. 22, 2013 (PCT/CA2013/050320); ISA/CA.
(Continued)

*Primary Examiner* — George Wyszomierski
*Assistant Examiner* — Janelle Morillo
(74) *Attorney, Agent, or Firm* — Banner & Witcoff, Ltd.

(57) ABSTRACT

An aluminum alloy having an excellent combination of strength, extrudability and corrosion resistance may include in weight percent, about 0.01% or less copper; about 0.15% or less iron; about 0.60 to about 0.90% manganese, where manganese and iron are present in the alloy in a Mn:Fe ratio of at least about 6.6; about 0.02% or less nickel; about 0.08
(Continued)

SWAAT Results - Experiment 1 to about 0.30% silicon; about 0.10 to about 0.20% titanium; and about 0.05 to about 0.20% zinc; the balance being aluminum and unavoidable impurities. Extruded articles and other articles may be formed using the alloy. Methods of forming such articles may include homogenizing a billet of the alloy prior to forming the article.

26 Claims, 3 Drawing Sheets

(51) Int. Cl.

| | |
|---|---|
| ***B21C 23/00*** | (2006.01) |
| ***F28F 21/08*** | (2006.01) |
| ***C21D 1/28*** | (2006.01) |
| ***C21D 9/08*** | (2006.01) |

(52) U.S. Cl.
CPC ..... *C22F 1/04* (2013.01); *F28F 21/084* (2013.01); *F28F 2255/16* (2013.01)

(56) References Cited

U.S. PATENT DOCUMENTS

| | | | | |
|---|---|---|---|---|
| 6,458,224 | B1 | 10/2002 | Ren et al. | |
| 6,638,376 | B2 | 10/2003 | Hasegawa et al. | |
| 6,908,520 | B2 * | 6/2005 | Taguchi ..... | C22F 1/04 148/689 |
| 6,939,417 | B2 | 9/2005 | Marois et al. | |
| 7,435,305 | B2 | 10/2008 | Shoji et al. | |
| 7,781,071 | B2 | 8/2010 | Parson et al. | |
| 8,025,748 | B2 | 9/2011 | Parson et al. | |
| 8,292,589 | B2 | 10/2012 | Koga | |
| 2001/0032688 | A1 | 10/2001 | Ren | |
| 2004/0154709 | A1 | 8/2004 | Taguchi et al. | |
| 2009/0301611 | A1 | 12/2009 | Parson et al. | |

FOREIGN PATENT DOCUMENTS

| | | | |
|---|---|---|---|
| CA | 2725837 | A1 | 12/2009 |
| DE | 102008056819 | B3 | 4/2010 |
| EP | 1564307 | A1 | 8/2005 |
| JP | 59193236 | A | 11/1984 |
| JP | 11172388 | A | 6/1999 |
| JP | 2000119784 | A | 4/2000 |
| WO | 9918250 | A1 | 4/1999 |
| WO | 2004057261 | A1 | 7/2004 |
| WO | 2013159233 | A1 | 10/2013 |

OTHER PUBLICATIONS

International Preliminary Examination Report (Chapter II) (PCT/CA2013/050320); IPEA/CA.
Nov. 22, 2013—(WO) International Search Report and Written Opinion—App PCT/CA2013/050722.
Apr. 1, 2016—(CN) Office Action—App 2013800492245.
May 23, 2016—(EP) Office Action—App EP 13838474.
Apr. 20, 2016—(EP) Supplemental Search Report—App EP 13838474.

* cited by examiner

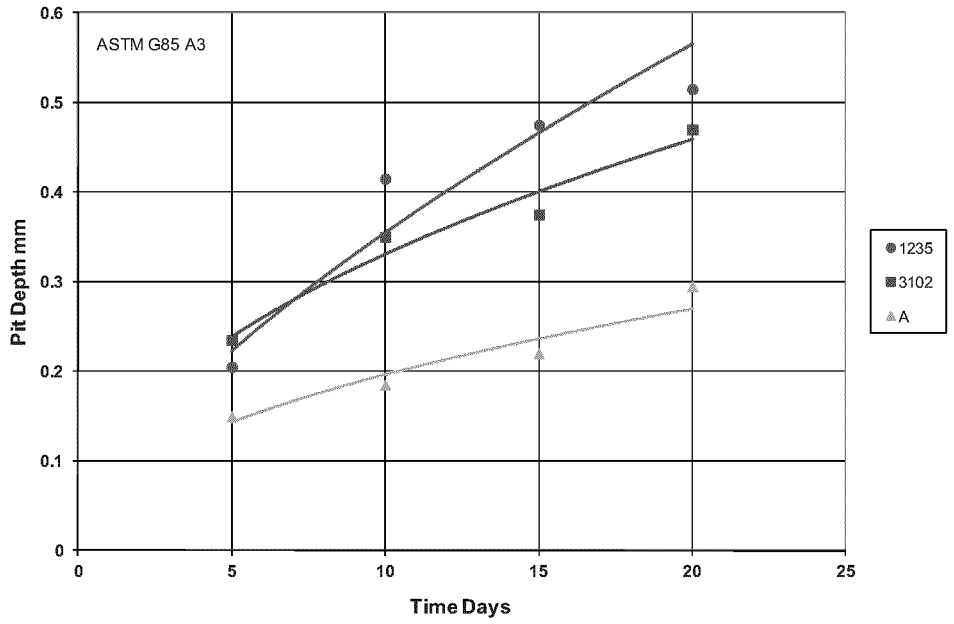
Figure 1: SWAAT Results - Experiment 1

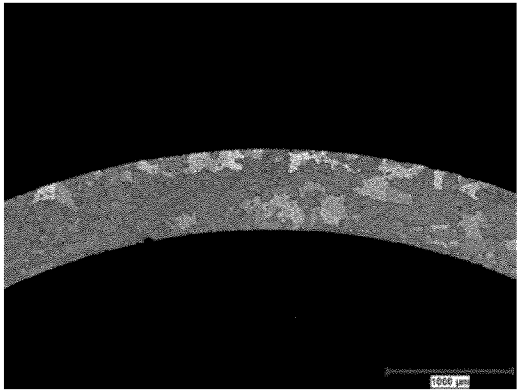
C – 580°C
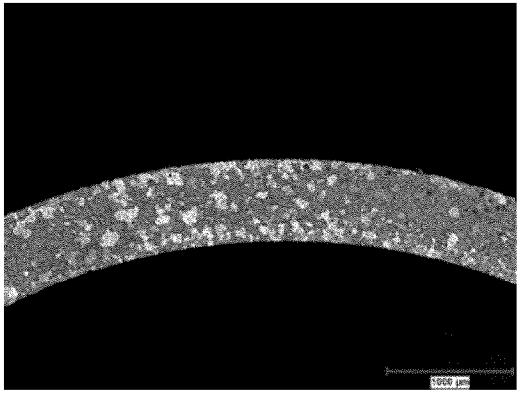
C-620°C
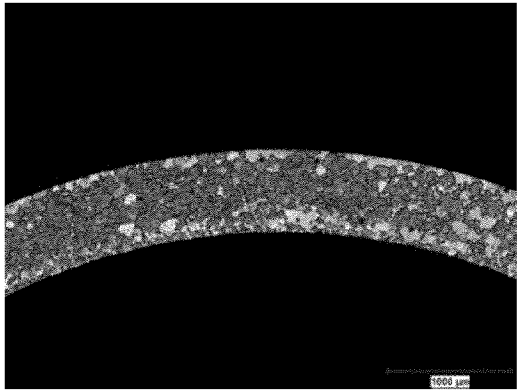
D- 620°C
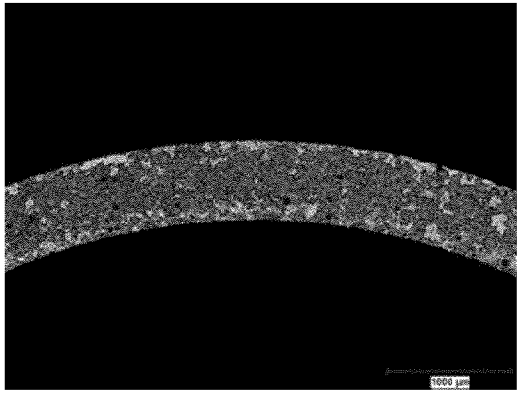
E – 620°C
Figure 2: Extruded Grain Structures - Transverse

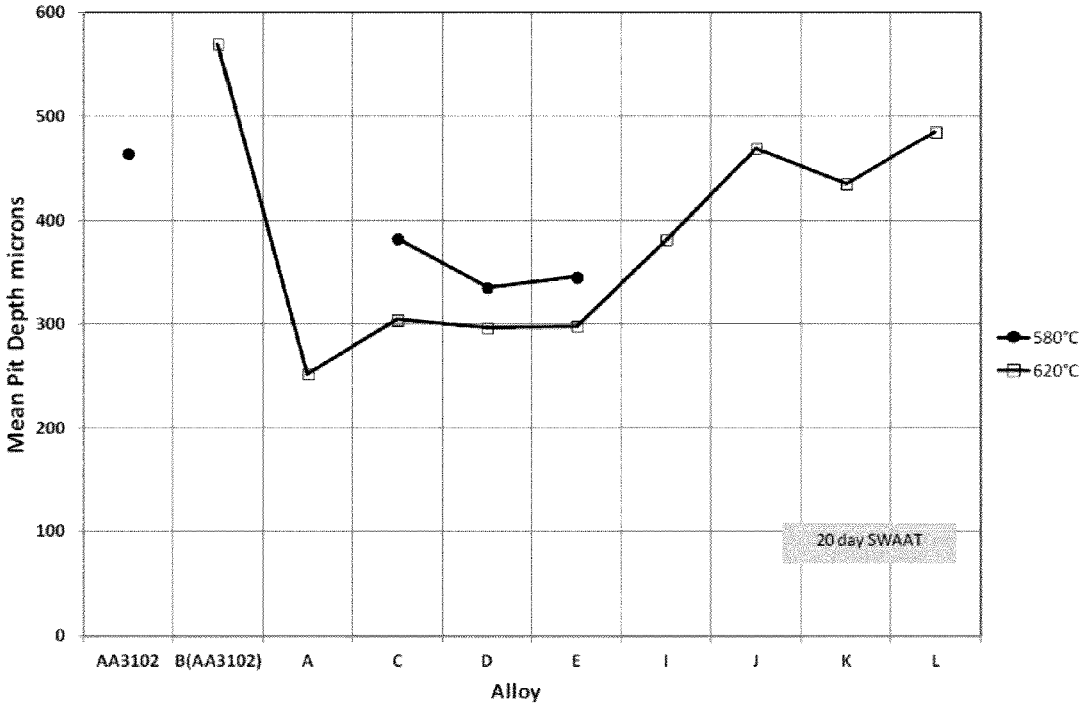
Figure 3: SWAAT Results - Experiment 4

ALUMINUM ALLOY HAVING AN EXCELLENT COMBINATION OF STRENGTH, EXTRUDABILITY AND CORROSION RESISTANCE

CROSS-REFERENCE TO RELATED APPLICATIONS

The present application is a U.S. National Phase filing of International Applications PCT/CA2013/050320, filed on Apr. 26, 2013, designating the United States of America and claiming priority to Canada Patent Application No. 2,776,003, filed Apr. 27, 2012; U.S. Provisional Application Ser. No. 61/639,444, filed Apr. 27, 2012; and U.S. Provisional Application Ser. No. 61/643,637, filed May 7, 2012; all of which applications are incorporated herein by reference in their entireties.

TECHNICAL FIELD

The present invention relates to an aluminum alloy having an excellent combination of strength, extrudability and corrosion resistance, as well as to extruded articles and other articles formed of the alloy and methods of forming such articles.

BACKGROUND

Aluminum alloys are often used for various heat transfer applications. In one example, tubing for heat exchanger applications, such as HVAC (heating ventilation and air conditioning and refrigeration), may be formed of aluminum alloy, such as by extrusion. Existing aluminum alloys may not provide satisfactory properties, including satisfactory combinations of strength, extrudability, formability, and corrosion resistance. The current baseline alloy is AA3102, which provides the required strength but has poor corrosion resistance.

The present alloys, articles, and methods are provided to address at least some of the problems discussed above and other problems, and to provide advantages and aspects not provided by prior technologies of this type. A full discussion of the features and advantages of the present invention is deferred to the following detailed description, which proceeds with reference to the accompanying drawings.

BRIEF SUMMARY

The following presents a general summary of aspects of the invention in order to provide a basic understanding of the invention. This summary is not an extensive overview of the invention. It is not intended to identify key or critical elements of the invention or to delineate the scope of the invention. The following summary merely presents some concepts of the invention in a general form as a prelude to the more detailed description provided below.

Aspects of the invention relate to an aluminum alloy having an excellent combination of strength, extrudability and corrosion resistance. The alloy may be suitable for various heat transfer applications, including heat exchanger applications such as HVAC and hairpin type air conditioning condensers. As one example, the alloy may be used to form tubing for such applications, which may be produced by extrusion or another forming technique. The alloy may also be suitable for the manufacture of other products, such as sheet in one example. Tube stock can also be formed from sheets formed of the alloy, as well as other articles.

According to one aspect, the aluminum alloy may include, in weight percent:

Cu about 0.01% or less;
Fe about 0.15% or less;
Mn about 0.60% to about 0.90%;
Ni less than about 0.02%;
Si about 0.08% to about 0.30%;
Ti about 0.10% to about 0.20%; and
Zn about 0.05% to about 0.20%;

with the balance being aluminum and unavoidable impurities. The manganese content and the iron content may be maintained such that manganese and iron are present in the alloy in a Mn:Fe ratio of at least about 6.6.

According to additional aspects, the iron content of the alloy may be about 0.05% to about 0.15%, or may be about 0.12% or less, optionally with a minimum of about 0.05%. The manganese content of the alloy may be about 0.80% to about 0.90%. The nickel content of the alloy may be less than about 0.01%. The silicon content of the alloy may be about 0.10% to about 0.20%. The zinc content of the alloy may be about 0.1% to about 0.2%. The Mn:Fe ratio may be about 6.6 to about 11.0, or may be about 6.6 to about 7.5. The alloy may include any combination of such compositions in various embodiments.

According to another aspect, the alloy may have a tensile strength of 75 MPa or more, or may have a tensile strength of 80 MPa or more. The alloy may additionally or alternately have a 20-day corrosion pit depth of about 400 μm or less, or about 380 μm or less, or about 300 μm or less. The corrosion pit depth of the alloy may be determined using SWAAT testing as described herein with respect to Example 1.

According to a further aspect, the alloy may be formed into a billet and the billet may be formed into another article using a variety of forming techniques, including extrusion, forging, rolling, and other forming techniques. In one example, the alloy may be particularly suitable for forming by extrusion, and may be extruded (e.g. in billet form) to form an extruded tube or other extruded article. After extrusion, such an article may have a grain size of less than about 75 microns, or less than about 100 microns, in the transverse (e.g. circumferential) direction. In another example, the billet may be rolled to form a sheet, and the sheet may be formed into a tube.

Additional aspects of the invention relate to a method of forming an article formed at least partially of an alloy as described above. In an embodiment, the alloy is shaped into a billet (e.g. by casting), and then the billet may be subjected to a homogenizing heat treatment, e.g. at a temperature of about 600-640° C. for about 2-8 hours. The billet may optionally be cooled at a rate of about 250° C./hour or less to a temperature of about 300° C. The billet may then be formed into one or more articles, by using a forming technique such as those described above. In one embodiment, the billet may be subjected to extrusion to form an extruded article such as extruded tubing.

According to one aspect, the homogenized billet may have a conductivity of 32-42% IACS (international annealed copper standard), or may have a conductivity of 33-38% IACS. The homogenized billet has a flow stress of less than about 22 MPa when measured at 500° C., at a strain rate of 0.1/sec.

According to another aspect, the article formed may have a tensile strength of 75 MPa or more, or may have a tensile strength of 80 MPa or more. Such an article may additionally or alternately have a 20-day corrosion pit depth of about 400 μm or less, or about 380 μm or less, or about 300 μm or less. The corrosion pit depth of the alloy may be determined using SWAAT testing as described herein with respect to Example 1.

Further aspects of the invention relate to an article partially or completely formed of an alloy as described above. Such an article may be formed using a method as described above as well. The article may be an extruded article in one example, such as extruded tubing or another component for use in heat exchanger applications. The article may be tubing or another component for heat exchanger applications formed in a different manner, in another example.

According to one aspect, an extruded article may have a grain size of less than about 75 microns, or less than about 100 microns, in the transverse direction. The article may also have a tensile strength of 75 MPa or more, or may have a tensile strength of 80 MPa or more.

Other features and advantages of the invention will be apparent from the following description taken in conjunction with the attached drawings.

DESCRIPTION OF THE DRAWINGS

To allow for a more full understanding of the present invention, it will now be described by way of example, with reference to the accompanying drawings in which:

FIG. 1 is a graph showing SWAAT results for Example 1 described in the present specification;

FIG. 2 shows metallographic transverse cross-sections for alloys C, D and E according to Example 2 described in the present specification; and FIG. 3 is a graph showing SWAAT results for Example 4 described in the present specification.

DETAILED DESCRIPTION

In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention.

Aspects of the present invention relate to aluminum alloys that can provide advantageous tensile strength, corrosion resistance, extrudability, and/or formability, as well as articles formed partially or entirely of such alloys and methods of producing such articles. Alloys according to the present invention may include alloying additions and limits as described below.

Copper may be included in embodiments of the alloy, such as in an amount of about 0.01% or less in one embodiment. Restricting copper content to this amount can improve corrosion resistance over alloys with higher copper contents.

Iron may be included in embodiments of the alloy, such as in an amount of about 0.15% or less in one embodiment. In other embodiments, the iron content of the alloy may be about 0.05% to about 0.15%, or may be about 0.12% or less, optionally with a minimum of about 0.05%. This amount of iron can improve corrosion resistance over alloys with higher iron contents.

Manganese may be included in embodiments of the alloy, such as in an amount of about 0.60 to about 0.90% in one embodiment. The manganese content of the alloy may be about 0.80% to about 0.90% in another embodiment. Manganese additions in these amounts can increase the strength of the alloy, which may compensate for lower strength that may result from lower iron contents.

Nickel may be included in embodiments of the alloy, such as in an amount of about 0.02% or less in one embodiment. The nickel content of the alloy may be about 0.01% or less in another embodiment.

Magnesium may be included in embodiments of the alloy, such as in an amount of less than about 0.05% in one embodiment. Magnesium may be in the form of an impurity, and may not be required, in one embodiment.

Silicon may be included in embodiments of the alloy, such as in an amount of about 0.08 to about 0.30% in one embodiment. The silicon content of the alloy may be about 0.10% to about 0.20% in another embodiment. Silicon additions in these amounts can reduce flow stress and improve extrudability of the alloy, which may be negatively affected by manganese additions.

Titanium may be included in embodiments of the alloy, such as in an amount of about 0.10 to about 0.20% in one embodiment. Titanium additions in these amounts can improve corrosion resistance of the alloy. Titanium may also be included in smaller amounts as a grain refining addition in another embodiment.

Zinc may be included in embodiments of the alloy, such as in an amount of about 0.05 to about 0.20% in one embodiment. The zinc content of the alloy may be about 0.1% to about 0.2% in another embodiment. Zinc additions in these amounts can improve corrosion resistance of the alloy.

In example embodiments, the manganese and iron contents of the alloy may be maintained in a Mn:Fe ratio of at least about 6.6, or about 6.6 to about 11.0, or about 6.6 to about 7.5. Using manganese and iron in the above ratios can produce alloys with improved corrosion resistance and comparable or superior strength to existing aluminum alloys.

In one example embodiment, the alloy includes:

- about 0.01% or less copper;
- about 0.15% or less iron;
- about 0.60 to about 0.90% manganese, where the manganese and iron are present in the alloy in a Mn:Fe ratio of at least about 6.6;
- about 0.02% or less nickel;
- about 0.08 to about 0.30% silicon;
- about 0.10 to about 0.20% titanium; and
- about 0.05 to about 0.20% zinc;

with the balance being aluminum and unavoidable impurities.

In another example embodiment, the alloy includes:

- about 0.01% or less copper;
- about 0.15% or less iron;
- about 0.80 to about 0.90% manganese, wherein manganese and iron are present in the alloy in a Mn:Fe ratio of at least about 6.6;
- about 0.02% nickel or less;
- about 0.10 to about 0.20% silicon;
- about 0.10 to about 0.20% titanium; and
- about 0.10 to about 0.20% zinc;

with the balance being aluminum and unavoidable impurities.

In further embodiments, alloys of the present invention may comprise other combinations of the above alloying additions, or may consist only of or consist essentially of the combinations identified above. In one embodiment, the unavoidable impurities in the alloy may be present in amounts of 0.05% or less individually and 0.15% or less in aggregate.

Various embodiments of aluminum alloys as described herein may be used to produce a large number of different articles. In one embodiment, the alloy may have properties suitable for extrusion to produce a variety of extruded products, including tubing and other articles for use in heat exchanger and HVAC applications. Such extruded articles may have a constant cross-sectional shape over the entire length of the article. In another embodiment, other articles may be produced using an embodiment of the alloy, using other forming techniques. The alloy may be used to produce rolled sheet in one example, and such sheet may further be used to produce other articles, such as tubing and other articles for use in heat exchanger and HVAC applications. As an example, a rolled sheet produced using an embodiment of the alloy may be formed and welded (e.g. resistance welding) to form round tubestock. The article formed may have additional components that may or may not be formed of an alloy as described herein. For example, the article may have other components connected thereto by various connection techniques, such as by incorporating the article into a larger assembly, and/or may have coatings or other materials applied thereto. Additionally, the article may not be made entirely from the alloy in another embodiment, and may include other materials, such as being at least partially made from a composite material that includes the alloy.

Different methods may be used to produce different articles using embodiments of the aluminum alloy described herein. In one general embodiment, the alloy may be used to produce a billet, such as by casting, which can then be used to produce one or more articles, using one or more forming techniques. The term "billet" as used herein may refer to traditional billets, as well as ingots and other intermediate products that may be produced via a variety of techniques, including casting techniques such as continuous or semi-continuous casting and others.

After being shaped into a billet (e.g. by casting), the alloy/billet may be subjected to a modified homogenization cycle to develop and/or maintain desired properties. For example, such a homogenization treatment can assist in minimizing the alloy flow stress and creating an excellent combination of corrosion resistance, extrudability and grain size.

In one embodiment, the homogenizing heat treatment may include heating at a temperature of about 570-640° C. or 580-640° C. for about 2-8 hours. In another embodiment, the heat treatment may be conducted at about 600-640° C. for about 2-8 hours. As one example of this, the homogenizing treatment may be performed at a temperature of about 620° C. for about 4 hours. After the homogenizing treatment, the billet may then optionally be cooled at a rate of about 250° C./hour or less to a temperature of about 300° C. In another embodiment, the billet may be cooled at a rate of less than about 200° C./hour. Additional or alternate heat treatments may be used in other embodiments, including alternate homogenizing treatments, which may include different heating and/or cooling cycles.

In one embodiment, the homogenized billet may have an electrical conductivity of 32-42% IACS (international annealed copper standard), or may have an electrical conductivity of 33-38% IACS. Conductivities in these ranges can be used to measure and/or determine that the billet has a proper combination of composition and homogenization processing. In another embodiment, the homogenized billet may have a flow stress of less than about 22 MPa when measured at 500° C., at a strain rate of 0.1/sec, which is beneficial for extrusion.

The method may further include forming the billet into one or more articles using one or more forming techniques, such as the example articles and forming techniques discussed herein. For example, the billet may be shaped into tubing for use in heat transfer applications. In one embodiment, the billet is extruded into tubing, resulting in tubing that has an excellent combination of corrosion resistance, extrudability and formability. One embodiment of such extruded tubing may have a tensile strength (UTS) of about 75 MPa or more, or a tensile strength of about 80 MPa or more. Additionally, one embodiment of such extruded tubing may have a grain size of less than about 75 microns in the transverse direction (i.e. transverse to the extrusion direction), and in another embodiment, the grain size may be less than about 100 microns in the transverse direction. In an extruded tube, the transverse direction is generally the circumferential direction. In a further embodiment, tubing may be formed from rolled sheet produced from an ingot, as described above, and such tubing may have similar properties. Other forming techniques may be used to produce these and other articles from billets formed of the alloy in accordance with further embodiments.

Below are examples illustrating alloys produced according to embodiments of the present invention, and examples of properties that can be achieved by such alloys and articles formed therefrom.

Example 1

The alloys in Table 1 were DC cast as 101 mm diameter ingots and homogenized with a cycle of 4 hours at 580° C., then cooled at less than 200° C./hour. These included reference alloys AA3102 and AA1235A and an experimental alloy A in accordance with an embodiment of the invention, containing deliberate additions of Zn and Ti, reduced Fe content and an increased Mn content.

TABLE 1

Experimental Compositions - Example 1

| | AA3102 | AA1235 | A |
|---|---|---|---|
| Si | 0.07 | 0.12 | 0.08 |
| Fe | 0.44 | 0.33 | 0.1 |
| Cu | <.01 | <.01 | 0.002 |
| Mn | 0.23 | <.01 | 0.68 |
| Mg | <.01 | <.01 | <.01 |
| Ni | <.01 | 0.01 | <.01 |
| Zn | 0.02 | 0.02 | 0.16 |
| Ti | 0.02 | 0.02 | 0.14 |
| Mn/Fe | 0.52 | | 6.80 |

The three alloys were extruded into a 30×1.4 mm strip using the following conditions:

Billet temperature: 500° C.

Exit speed: 63 m/min

Extrusion ratio: 210

The strip was water quenched after extrusion, cut into coupons then degreased and exposed to the SWAAT test (ASTM G85 A3) for 5, 10, 15 and 20 days. The resulting pit depth (mean of 6 deepest pits) was assessed according to ASTM G46, and these values are presented in FIG. 1. It is noted that all corrosion pit depth testing described herein was performed in accordance with these testing procedures.

Alloy A clearly exhibited reduced depth of attack compared to the standard alloys tested. Tensile properties and corrosion potentials (G69) for each alloy were measured and the results are given in Table 2.

TABLE 2

Tensile Strength and Corrosion Potential - Example 1

| Alloy | UTS | Ecorr mV |
|---|---|---|
| AA1235 | 74.5 | −758 |
| AA3102 | 77.9 | −742 |
| A | 79.3 | −735 |

The modified alloy composition A is capable of meeting the same strength as the standard alloys, and the corrosion potential is slightly more noble, which increases galvanic protection when coupled with a fin material.

Example 2

A tensile strength of about 80 MPa or more is more desirable for HVAC applications to permit thinner tube walls while still meeting burst pressure requirements. In order to approach this property target, a series of alloys were produced containing increased Mn content and an Fe content that was reduced with respect to the reference alloys. The alloys were cast as in Example 1. The alloy compositions are listed in Table 3.

TABLE 3

Alloy Compositions - Example 2

| | B (AA3102) | C | D | E | F | G | H | I | J | K | L |
|---|---|---|---|---|---|---|---|---|---|---|---|
| Si | 0.33 | 0.09 | 0.15 | 0.24 | 0.08 | 0.09 | 0.11 | <.10 | 0.15 | 0.15 | 0.23 |
| Fe | 0.53 | 0.12 | 0.12 | 0.11 | 0.11 | 0.09 | 0.11 | 0.25 | 0.25 | 0.4 | 0.4 |
| Cu | 0.003 | 0.002 | <.01 | 0.002 | <.01 | <.01 | <.01 | <.01 | <.01 | <.01 | <.01 |
| Mn | 0.34 | 0.82 | 0.82 | 0.82 | 0.22 | 0.62 | 0.25 | 0.6 | 0.84 | 0.84 | 0.84 |
| Mg | <.01 | <.01 | <.01 | <.01 | <.01 | <.01 | <.01 | <.01 | <.01 | <.01 | <.01 |
| Ni | <.01 | <.01 | <.01 | <.01 | <.01 | <.01 | <.01 | <.01 | <.01 | <.01 | <.01 |
| Zn | 0.02 | 0.16 | 0.16 | 0.16 | 0.01 | <.01 | 0.18 | 0.17 | 0.17 | 0.17 | 0.17 |
| Ti | 0.02 | 0.14 | 0.14 | 0.15 | 0.02 | 0.02 | 0.19 | 0.15 | 0.15 | 0.15 | 0.15 |
| Mn/Fe | 0.64 | 6.83 | 6.83 | 7.45 | 2.00 | 6.89 | 2.27 | 2.40 | 3.36 | 2.10 | 2.10 |

Alloys A (Example 1), B, C, D and E were homogenized for 4 hours at either 620 or 580° C. and cooled at less than 200° C./hr. Samples having 10 mm diameters and 15 mm length were machined and tested under plane strain compression at an applied strain rate of 0.1/sec and a test temperature of 500° C. The results are presented in Table 4, ranked in terms of decreasing flow stress ($\sigma_f$). For 3XXX alloy extrusions, the flow stress is a good indicator of extrusion pressure which in turn is an indicator of the ease or extrusion or the extrudability. A more extrudable alloy can be extruded faster on a given press and the profile die exit temperature is lower, which extends the life of the tooling. The results (Table 4) show that increasing the Mn content from alloy A to C to increase the tensile strength and burst pressure of the alloy when extruded as tubing increases the flow stress by ~3 to 5%. However, this can be offset by raising the homogenization temperature to 620° C. and further offset by increasing the silicon content from <0.10 wt % to 0.15 wt % (i.e. Alloy D). Still further increasing the Si content to 0.24 wt % (alloy E) gives even further reductions in flow stress. Additionally, it was observed that the use of the higher homogenization temperature (620° C. in this example) achieves greater benefits in flow stress with alloys having higher silicon contents (e.g. Alloy E). In this way, the alloy tensile strength can be increased without loss of extrudability. Alloy B also exhibited good flow stress, although it is noted that alloy B has corrosion resistance that is inferior to that of alloys A, C, D, and E. Testing was also performed to determine electrical conductivity (% IACS). Table 4 illustrates these test results for the various example alloys. Please note that Δ % indicates the difference in flow stress ($\sigma_f$) from the sample with the highest flow stress among those tested, which in this case, was alloy E homogenized at 580° C.

TABLE 4

Plane Strain Compression Results

| Alloy | Mn | Fe | Si | Homo. Temp ° C. | $\sigma_f$ | Δ % | % IACS | UTS (MPa) |
|---|---|---|---|---|---|---|---|---|
| B | 0.34 | 0.53 | 0.33 | 620 | 14.80 | −33.3 | 51.81 | 84.30 |
| B | 0.34 | 0.53 | 0.33 | 580 | 18.25 | −17.8 | 53.17 | 91.00 |
| E | 0.82 | 0.11 | 0.24 | 620 | 19.25 | −13.3 | 37.39 | 86.10 |
| D | 0.82 | 0.12 | 0.15 | 620 | 20.10 | −9.5 | 34.32 | 87.30 |
| A | 0.68 | 0.10 | 0.08 | 580 | 20.20 | −9.0 | 34.83 | 75.30 |
| A | 0.68 | 0.10 | 0.08 | 620 | 20.27 | −8.7 | 34.67 | 80.80 |
| C | 0.82 | 0.12 | 0.09 | 620 | 20.60 | −7.2 | 33.25 | 87.50 |
| C | 0.82 | 0.12 | 0.09 | 580 | 21.30 | −4.1 | 34.55 | 87.00 |
| D | 0.82 | 0.12 | 0.15 | 580 | 21.50 | −3.2 | 37.47 | 88.90 |
| E | 0.82 | 0.11 | 0.24 | 580 | 22.20 | 0.0 | 41.71 | 86.70 |

Alloys C, D and E were homogenised to the same conditions as shown in Table 4 were extruded into a 11.3× 0.71 mm tube at a billet temperature of 480° C., an exit speed of 50 m/min and an extrusion ratio of 535. Cross sections were taken and prepared metallographically. FIG. 2 shows the transverse grain structure. The grain sizes of these samples in the transverse (circumferential) direction were as follows:

Alloy C/580° C.: 121 microns

Alloy C/620° C.: 46 microns

Alloy D/620° C.: 56 microns

Alloy E/620° C.: 51 microns

A fine grain size advantageously avoids "orange peel" formation on the tube surface during bending, expansion or flaring. This defect results from independent deformation of individual grains, which can result in surface roughening and grain boundary cracking. The grain size for alloy C homogenised at 580° C. was >100 microns, which is large enough to promote this defect. Increasing the homogenisation temperature for alloy C decreased the grain size to a more desirable level (e.g. less than 100 microns or less than 75 microns), and this was maintained for alloys D and E at the high homogenisation temperature.

Example 3

Manganese in solid solution can have a considerable effect on the conductivity of the billet. Thus, conductivity may be used to track the homogenization process in one embodiment of the present invention. Electrical conductivity IACS (international annealed copper standard) of the homogenised billets was measured using a hand-held probe at the end of the billet. The results are presented in Table 5 below.

TABLE 5

Conductivity IACS Results

| | A | B | C | D | E | F | G | H |
|---|---|---|---|---|---|---|---|---|
| 4 hrs/580° C. | 36.2 | 53.2 | 34.6 | 37.5 | 41.8 | 48.8 | 39.6 | 43 |
| 4 hrs/620° C. | 34.6 | | 33.3 | 34.3 | 37.4 | | | |

Example 4

Alloys A-D, I, J, K, and L, along with a commercial AA3102 alloy, were extruded into a 30 mm×1.4 mm strip using the conditions described in Example 1. All of the alloys with the exception of AA3102, but including Alloy B (AA3102), were homogenized prior to extrusion for 4 hours at 620° C. and cooled at a rate of less than 200° C. per hour. Additional billets of Alloys C, D, and E, along with a billet of the commercial AA3102 were extruded in the same manner and were homogenized prior to extrusion for 4 hours at 580° C. and cooled at a rate of less than 200° C. per hour. The samples were exposed in SWAAT testing for 20 days as described above with respect to Example 1, and pit depths were measured, as described in Example 1 above. Table 6 below summarizes the data for the experimental alloys, ranked in terms of increasing pit depth, with the alloys identified by composition information and homogenization cycle information. The results for the two AA3102 alloys (identified as AA3102 and Alloy B) are given at the bottom of the table for reference. The same data is presented graphically in FIG. 3.

TABLE 6

20-day SWAAT Results

| Alloy | Mn | Fe | Si | Zn | Ti | Mn/Fe | Homo Temp ° C. | 20 day pit depth μ |
|---|---|---|---|---|---|---|---|---|
| D | 0.82 | 0.12 | 0.15 | 0.16 | 0.14 | 6.83 | 580 | 335 |
| E | 0.82 | 0.11 | 0.24 | 0.16 | 0.15 | 7.45 | 580 | 345 |
| C | 0.82 | 0.12 | 0.09 | 0.16 | 0.14 | 6.83 | 580 | 382 |
| A | 0.68 | 0.10 | 0.08 | 0.16 | 0.14 | 6.80 | 620 | 253 |
| D | 0.82 | 0.12 | 0.15 | 0.16 | 0.14 | 6.83 | 620 | 296 |
| E | 0.82 | 0.11 | 0.24 | 0.16 | 0.15 | 7.45 | 620 | 298 |
| C | 0.82 | 0.12 | 0.09 | 0.16 | 0.14 | 6.83 | 620 | 304 |
| I | 0.60 | 0.25 | <.10 | 0.17 | 0.15 | 2.40 | 620 | 381 |
| K | 0.84 | 0.40 | 0.15 | 0.17 | 0.15 | 2.10 | 620 | 435 |
| J | 0.84 | 0.25 | 0.15 | 0.17 | 0.15 | 3.36 | 620 | 469 |
| L | 0.84 | 0.40 | 0.23 | 0.17 | 0.15 | 2.10 | 620 | 485 |
| AA3102 | 0.23 | 0.44 | 0.07 | 0.02 | 0.02 | 0.52 | 580 | 464 |
| B (AA3102) | 0.34 | 0.53 | 0.33 | 0.02 | 0.02 | 0.64 | 620 | 570 |

The highest pit depth was associated with the commercial AA3102 Alloy B containing high iron, a low Mn/Fe ratio, and no deliberate addition of Zn or Ti, except for Ti added for grain refinement. The lowest pit depths and correspondingly, the best corrosion performance, was exhibited by Alloys A, C, D, and E with deliberate additions of Zn and Ti and a Mn/Fe ratio greater than 6.6. Corrosion resistance for these alloys was further improved by increasing the homogenization temperature from 580° C. to 620° C. Alloys I-L gave performances that were superior to the commercial AA3102 Alloy B. However, although they contained deliberate Ti and Zn additions and were homogenized at 620° C., the corrosion performance of Alloys I-L was inferior to alloys A, C, D, and E, and were similar to the second commercial AA3102 alloy. In all cases, the Mn/Fe ratio for alloys I-L was below 3.5.

The results of these experiments (Examples 1-4) clearly show that alloy compositions according to the embodiments described herein exhibit superior corrosion performance to standard AA3102-type alloys. These results also show that alloys having an Mn/Fe ratio of greater than 6.6 exhibit improved corrosion resistance. The results further indicate that increasing the homogenization temperature to 620° C. further improves corrosion resistance, in addition to decreasing flow stress. In one embodiment, alloys according to the compositions described above may have a 20-day corrosion pit depth of about 400 nm or less, or about 380 nm or less. In another embodiment, alloys according to the compositions described above may have a 20-day corrosion pit depth of about 300 nm or less, particularly when homogenized at 620° C. The corrosion pit depth of the alloy may be determined using SWAAT testing as described herein with respect to Example 1.

As evidenced by the above examples, alloys as described herein can provide beneficial properties, including good tensile strength, excellent corrosion resistance, excellent extrudability, and/or excellent formability, offering a combination of such properties that exceeds those of other alloys tested. Such properties provide advantages for use in certain applications, for example aluminum tubing (extruded or other) for heat transfer applications, such as heat exchangers, hairpin type air conditioning condensers, and other components. Still other advantages are recognizable to those skilled in the art.

While the invention has been described with respect to specific examples including presently preferred modes of carrying out the invention, those skilled in the art will appreciate that there are numerous variations and permutations of the above described systems and methods. Thus, the spirit and scope of the invention should be construed broadly as set forth in the appended claims. All compositions herein are expressed in weight percent, unless otherwise noted. It is understood that compositions and other numerical values modified by the term "about" herein may be within the exact numerical values listed (i.e. disregarding the term "about")

in alternate embodiments, without departing from the present invention.

What is claimed is:

1. An aluminum alloy consisting essentially of, in weight percent:

about 0.01% or less copper;

about 0.15% or less iron;

about 0.60 to about 0.90% manganese, wherein manganese and iron are present in the alloy in a Mn:Fe ratio of at least about 6.6;

about 0.02% or less nickel;

about 0.08 to about 0.30% silicon;

about 0.10 to about 0.20% titanium; and about 0.05 to about 0.20% zinc;

the balance being aluminum and unavoidable impurities.

2. The aluminum alloy of claim 1, wherein the iron content is about 0.05 to about 0.15%.

3. The aluminum alloy of claim 1, wherein the manganese content is about 0.80 to about 0.90%.

4. The aluminum alloy of claim 1, wherein the nickel content is about 0.01% or less.

5. The aluminum alloy of claim 1, wherein the silicon content is about 0.10 to about 0.20%.

6. The aluminum alloy of claim 1, wherein the zinc content is about 0.10 to about 0.20%.

7. The aluminum alloy of claim 1, wherein the Mn:Fe ratio is about 6.6 to about 11.0.

8. The aluminum alloy of claim 1, wherein the alloy comprises, in weight percent, about 0.05 to about 0.12% iron; about 0.80 to about 0.90% manganese; about 0.02% or less nickel;

about 0.10 to about 0.20% silicon; and about 0.10 to about 0.20% zinc.

9. The aluminum alloy of claim 1, further comprising about 0.05% or less magnesium.

10. The aluminum alloy of claim 1, wherein the unavoidable impurities are present individually in an amount of 0.05% or less and in an amount of 0.15% or less in aggregate.

11. An article formed of an aluminum alloy consisting essentially of, in weight percent:

about 0.01% or less copper;

about 0.15% or less iron;

about 0.60 to about 0.90% manganese, wherein manganese and iron are present in the alloy in a Mn:Fe ratio of at least about 6.6;

about 0.02% or less nickel;

about 0.08 to about 0.30% silicon;

about 0.10 to about 0.20% titanium; and about 0.05 to about 0.20% zinc;

the balance being aluminum and unavoidable impurities.

12. The article of claim 11, wherein the article has a tensile strength of 75 MPa or more.

13. The article of claim 12, wherein the article has a tensile strength of 80 MPa or more.

14. The article of claim 11, wherein the article is an extruded article.

15. The article of claim 14, wherein the article is extruded tubing.

16. The article of claim 14, wherein the article has a grain size of less than about 100 microns in a transverse direction.

17. The article of claim 11, wherein the article is a tube, and wherein the article is formed by rolling a billet into a sheet and forming the sheet into the tube.

18. The article of claim 11, wherein the alloy comprises, in weight percent, about 0.05 to about 0.12% iron; about 0.80 to about 0.90% manganese; about 0.02% or less nickel; about 0.10 to about 0.20% silicon; and about 0.10 to about 0.20% zinc.

19. The article of claim 11, wherein the Mn:Fe ratio of the alloy is about 6.6 to about 11.0.

20. The article of claim 19, wherein the Mn:Fe ratio of the alloy is about 6.6 to about 7.5.

21. A method of forming an article, comprising:

forming a billet of the aluminum alloy consisting essentially of, in weight percent:

about 0.01% or less copper;

about 0.15% or less iron;

about 0.60 to about 0.90% manganese, wherein manganese and iron are present in the alloy in a Mn:Fe ratio of at least about 6.6;

about 0.02% or less nickel;

about 0.08 to about 0.30% silicon;

about 0.10 to about 0.20% titanium; and about 0.05 to about 0.20% zinc;

the balance being aluminum and unavoidable impurities;

homogenizing the billet at a homogenization temperature of about 580° C. to about 640° C. for about 2 to about 8 hours; and forming the article from the billet.

22. The method of claim 21, further comprising cooling the billet, after the homogenizing, at a rate of about 250° C. per hour or less to a temperature of about 300° C.

23. The method of claim 22, wherein the billet is cooled, after the homogenizing, at a rate of less than 200° C. per hour.

24. The method of claim 21, wherein the article is an extruded article, and the article is formed by using the billet in an extrusion process.

25. The method of claim 21, wherein the article is a tube, and wherein the article is formed by rolling the billet into a sheet and forming the sheet into the tube.

26. The method of claim 21, wherein the Mn:Fe ratio of the alloy is about 6.6 to about 11.0.

* * * * *